US005097653A

United States Patent [19]

Soloman

[11] Patent Number: 5,097,653

[45] Date of Patent: Mar. 24, 1992

[54] VERIFICATION SYSTEM FOR DETECTING THE PRESENCE AND ABSENCE OF AN OBJECT

[75] Inventor: Sabrie B. Soloman, Ridgewood, N.J.

[73] Assignee: Pfizer Inc., New York, N.Y.

[21] Appl. No.: 634,992

[22] Filed: Dec. 27, 1990

[51] Int. Cl.[5] ..... B65B 57/10

[52] U.S. Cl. ..... 53/499; 53/495; 493/9

[58] Field of Search ..... 53/499, 498, 495, 493, 53/494, 447, 443, 540, 541; 493/9

[56] References Cited

U.S. PATENT DOCUMENTS 3,133,481 5/1964 McCormick et al. ..... 493/9
4,266,674 5/1981 Bell et al. ..... 53/499 X
4,577,451 3/1986 Salicini ..... 493/9 X
4,680,919 7/1987 Hirama et al. ..... 53/499
4,856,262 8/1989 Uithoven ..... 53/499

*Primary Examiner*—James F. Coan
*Attorney, Agent, or Firm*—Peter C. Richardson; Paul H. Ginsburg; Grover F. Fuller, Jr.

[57] ABSTRACT

A verification system for detecting the presence and absence of an object includes a verification station. A preselected number of objects is delivered to the verification station with each object disposed at a selected position. A pneumatic comparator is located at each selected position. Each pneumatic comparator comprises a head directed toward its corresponding selected position. The head includes an exit port and an entry port whereby air may be discharged through the exit port and directed toward the selected position. If an object is located at the selected position the air is reflected back into the entry port where it is sensed to indicate the presence of the object.

19 Claims, 5 Drawing Sheets

VERIFICATION SYSTEM FOR DETECTING THE PRESENCE AND ABSENCE OF AN OBJECT

BACKGROUND OF THE INVENTION

This invention relates to a verification system for detecting the presence or absence of an object such as a carton. When a plurality of objects, such as cartons, are shipped and stored the objects are frequently packaged in a large container. It is desirable under certain circumstances to assure that the precise number of objects intended to be stored in the container is in fact stored therein. This is particularly important, for example, in the pharmaceutical industry where the absence of a carton from a container could result in a heavy fine to the pharmaceutical shipper since the missing carton may contain contents which could be harmful if misused.

It would be desirable to provide a reliable verification system to determine whether or not the intended number of objects, such as cartons, are in fact present when such objects are loaded into a container for shipping and storage. It would also be desirable if such a verification system could work on the non-contact basis.

SUMMARY OF INVENTION

An object of this invention is to provide a verification system and method which meets the above needs.

A further object of this invention is to provide such a verification system and method which can be conveniently and reliably operated in a non-contact manner.

In accordance with this invention, the verification system includes a verification station. A pre-selected number of objects are delivered to the verification system with each object intended to be disposed at a corresponding selected position in the verification station. A pneumatic comparator is located at each selected position. Each pneumatic comparator includes a head directed toward its corresponding selected position with the head having an exit port and entry port for the flow of air. Air is discharged from the exit port and directed toward the selected position. If an object is located in the position, the air is reflected by the object back to the entry port where the air pressure can be measured to indicate the presence of the object.

In a preferred embodiment of this invention, the verification system includes a frame-like structure having parallel sides disposed along the selected positions so that a pneumatic comparator could be located on each of the opposite parallel sides. Preferably, the objects are delivered to the verification station by a conveyor which causes the objects on a pallet fixed to a lift so that when all of the pre-selected number of objects are deposited on the pallet the lift can raise the objects into the verification station where the verification takes place. If all of the objects are in fact present the lift can raise the objects in line with a container and the objects would be deposited in the container in any suitable manner, such as by a ram having a pusher plate.

THE DRAWINGS

DETAILED DESCRIPTION

Figures 1, 3:
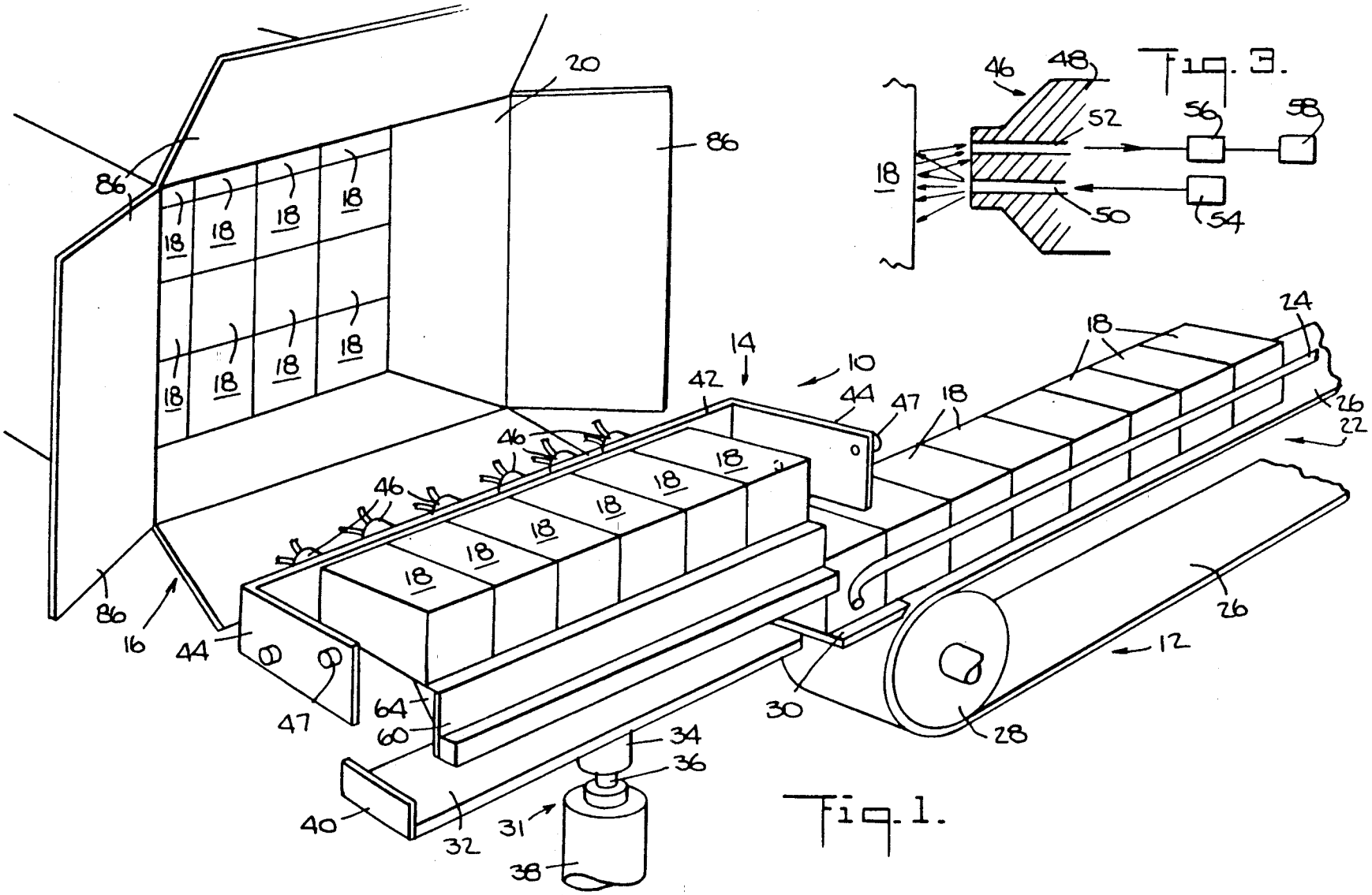
FIG. 1 is a perspective view schematically illustrating a verification system in accordance with this system.
FIG. 3 is an elevation view partly in section showing the pneumatic comparator used in the system of FIGS. 1-2.

As shown in FIG. 1, the verification system 10 of this invention includes a delivery station 12, a verification station 14 and a loading station 16. The delivery station 12 includes any suitable means for delivering a pre-selected number of objects 18, preferably individual folded cartons to the verification station 14 for ultimate packaging in a large box or container 20.

In the illustrated embodiment, a conventional conveyor 22 is used for delivering the objects 18. Conveyor 22 includes a pair of guide rails 24 located above the conveyor belt 26 which is mounted on rollers 28. Guide rails 24 assure that the objects or cartons 18 remain in proper alignment with each other so that the cartons may be delivered from the conveyor belt 26 onto an apron 30 and thence onto a pallet 32 connected to the head 34 of piston 36 which reciprocates in cylinder 38. Thus, the combination of pallet 32, head 34, piston 36 and cylinder 38 comprise a lift 31 which is preferably hydraulically operated to raise and lower in accordance with the intended phase of operation. Pallet 32 includes an abutment wall 40 to act as a stop for the cartons 18 being pushed onto pallet 32. Accordingly, by forming pallet 32 of a length corresponding to the overall length of a series of pre-selected number of cartons 18, there is assurance that only the pre-selected number of cartons will be deposited on pallet 32.

Figure 2:
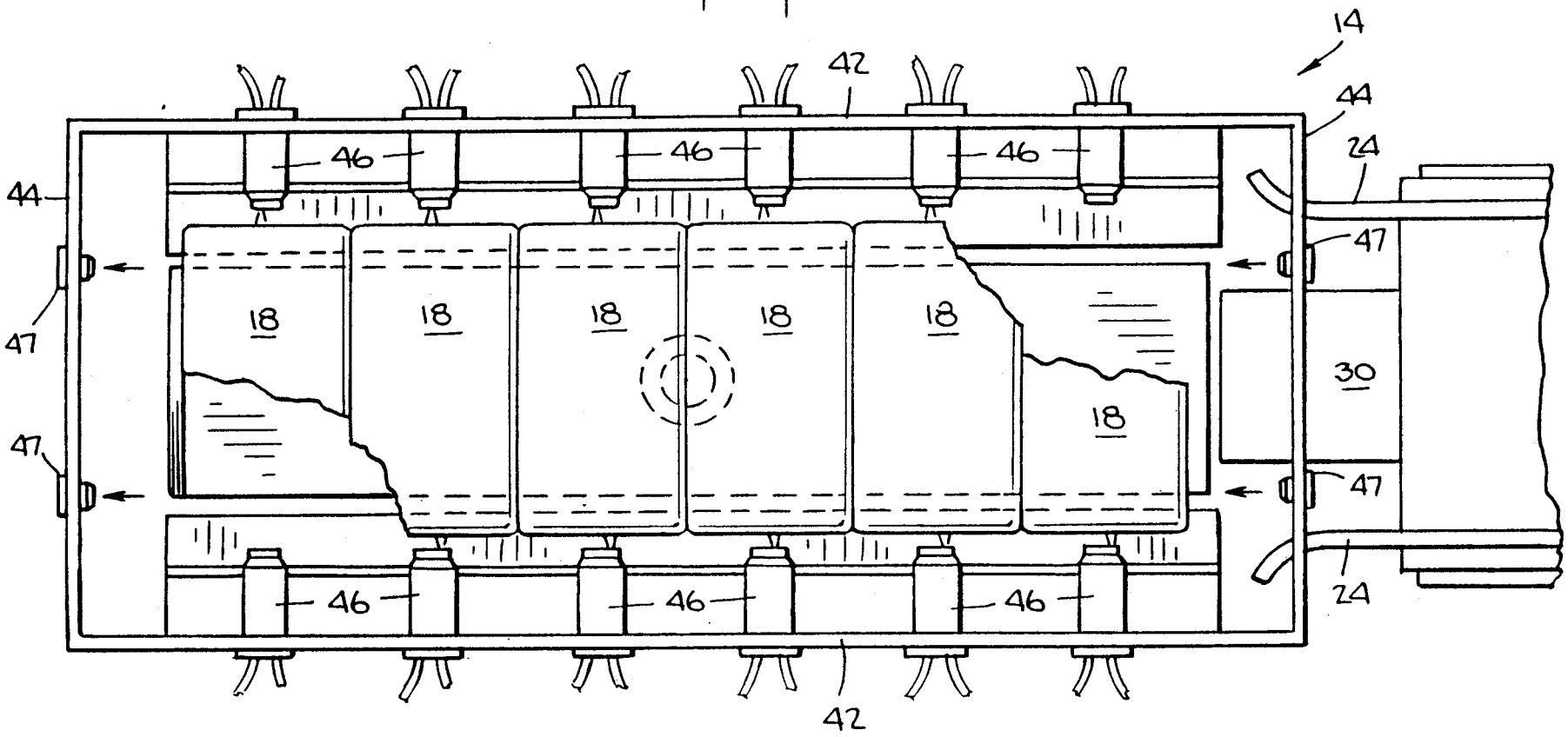
FIG. 2 is a top plan view of the verification station used in the system of FIG. 1.

FIGS. 2-3 illustrate the details of verification station 14. As shown therein, a rigid frame comprising parallel side walls 42 and end walls 44 delineate the verification station. The verification station 14 is divided into a number of selected positions corresponding to the number of cartons or objects 18 whose presence is intended to be detected. In the illustrated embodiment, for example, there are six such selected positions. When a full load is delivered into the verification station 14 by the raising of pallet 32, as later described, a corresponding carton 18 will be located in each selected position. In accordance with this invention a pneumatic comparator 46 is located on each side wall 42 at each selected position directed toward the object or carton 18. As later discussed optical sensors 47 are mounted to each end wall 44.

In the preferred practice of the invention a separate comparator is provided for each carton 18. The invention may be broadly practiced with single comparator movably mounted on side wall 42 to sequentially monitor each carton location.

FIG. 3 illustrates the details of each pneumatic comparator 46. As shown therein each pneumatic comparator 46 includes a head 48 having an exit port 50 and an entry port 52. Exit port 50 is in flow communication with a source 54 of fluid, preferably air, so that the air would flow under high pressure into head 48 and be discharged through exit port 50. If an object is present at the selected position, air is reflected by the object into entry port 52 as shown by the arrows in FIG. 3. An air pressure amplifier 56 of any suitable conventional construction is associated with entry port 52 to convert the reflected low compressed air pressure to a higher pressure signal that can easily be measured such as by sensor or detector 58 which is schematically shown in FIG. 3. Accordingly, each pneumatic comparator 46 operates by being supplied with constant air pressure which causes a reflection of some of the discharged air into entry port 52 at a relatively low pressure value with the low pressure value then being amplified so that it may be easily measured. Thus, when an object interrupts the air flow the pressure signal at the entry port decreases, indicating the presence of an object, such as an individual folding carton 18. The provision of oppositely disposed comparators 46 provides a reliable check on the pressure signal being detected.

As shown in FIG. 2, a pair of suitable optical sensors 47 are located on end walls 44 disposed at the corners of cartons 18. Optical sensors 47 operate in a known manner and further assure the detection of the presence of the object. The optical sensors, for example, are capable of detecting the edge of a thin object, such as paper of 0.001 meter thickness. Objects of any dimension and shape can be detected at a range of, for example, 0.003 meter minimum and 0.0150 meter maximum.

Figure 4:
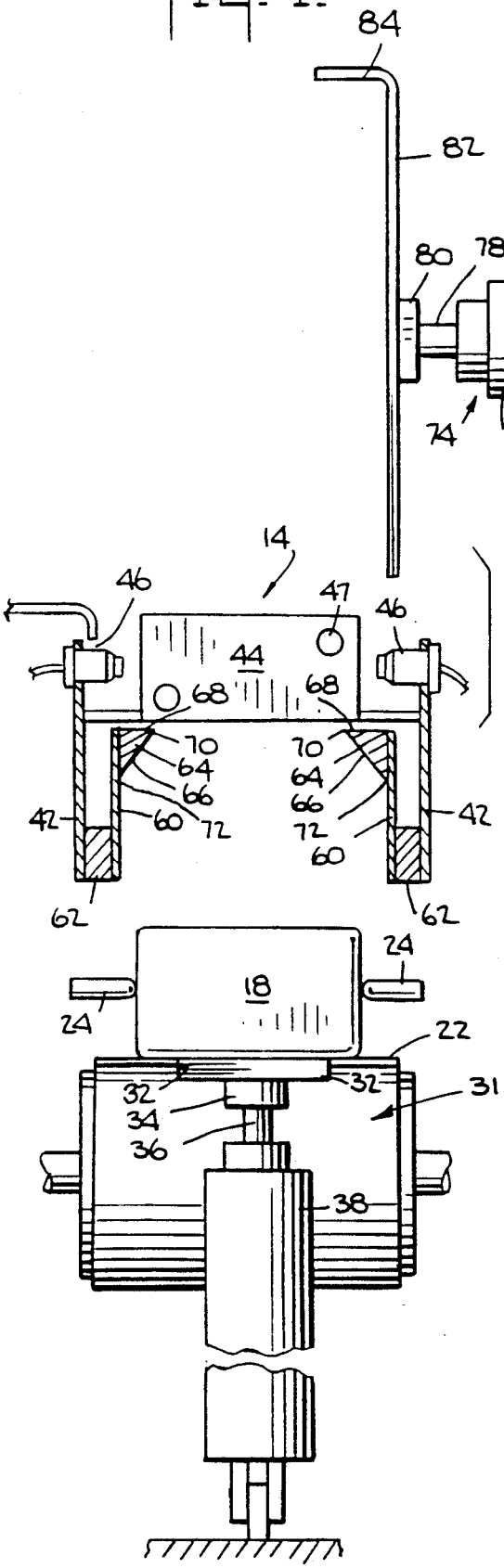
FIG. 4-7 are end elevation views showing the system of FIGS. 1-3 in different phases of operation.
Figure 5:
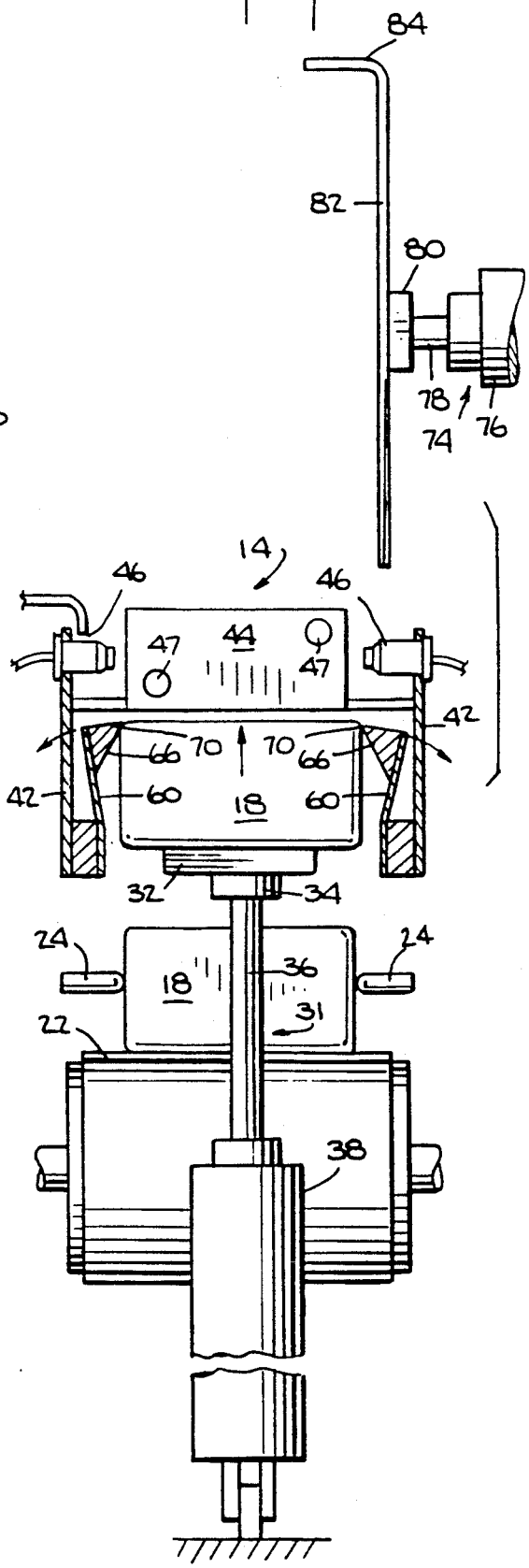
Figure 6:
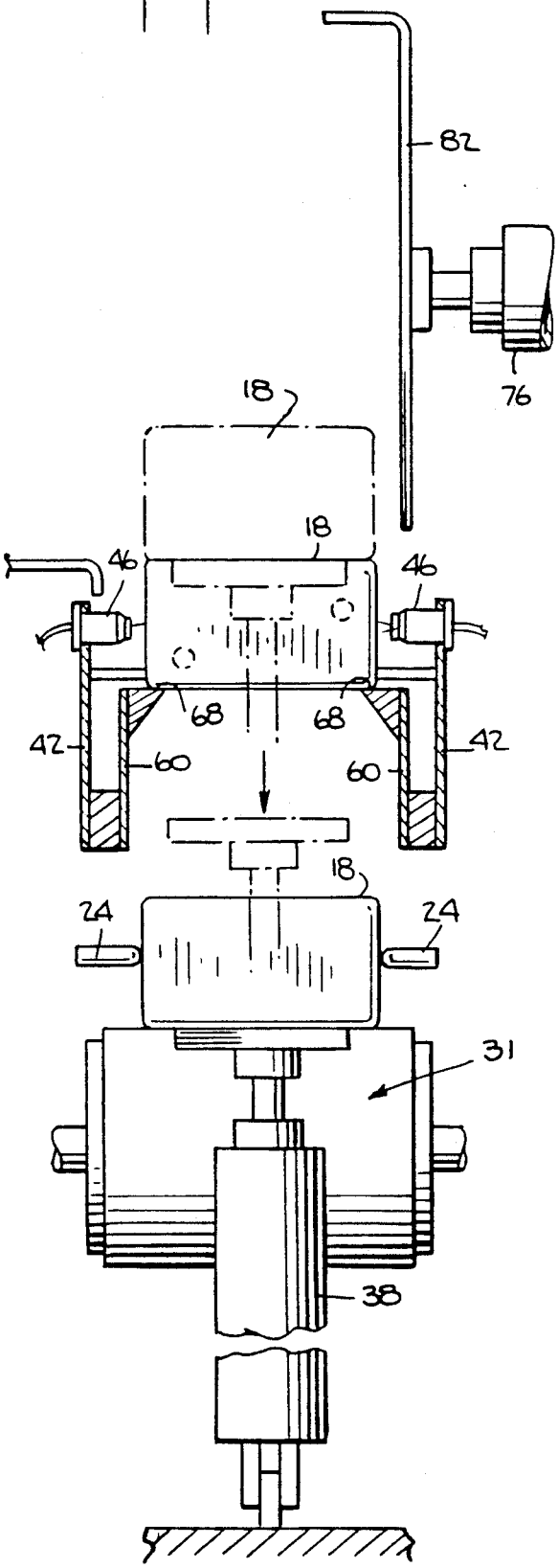
Figure 7:
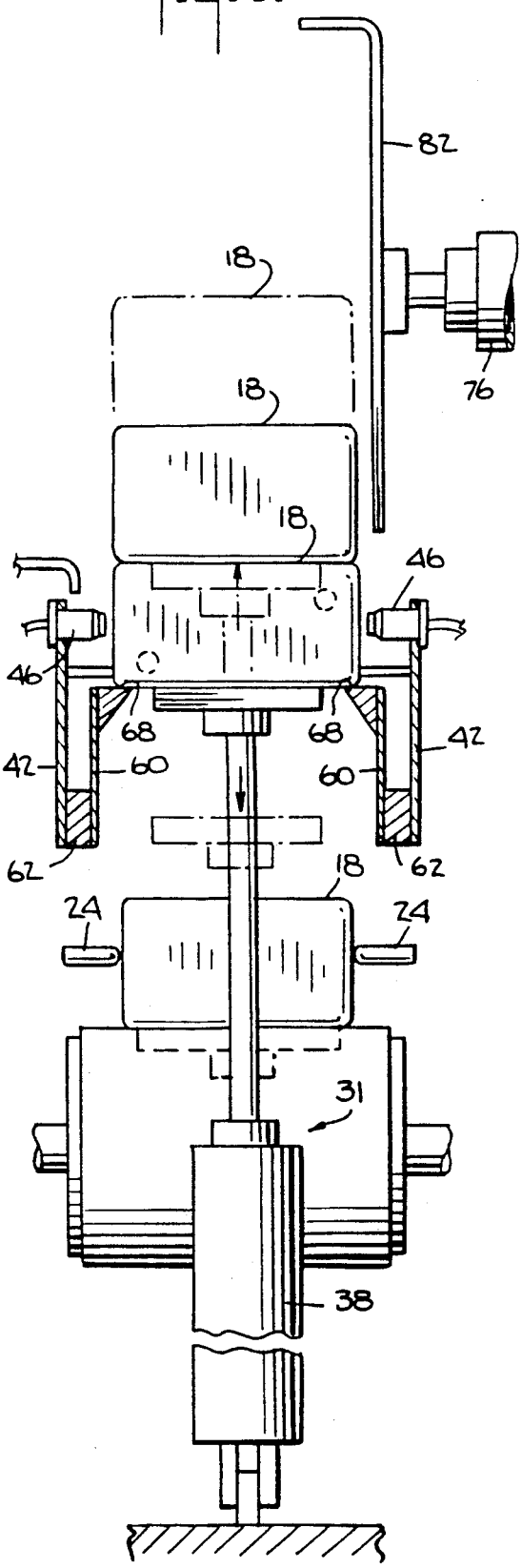

FIGS. 4–7 illustrate the sequence of operation from the delivery of the cartons 18 to the verification station 14 and then to their ultimate loading in container 20. As shown in FIG. 4, the cartons 18 are delivered onto pallet 32 of lift 31. Pallet 32 is located directly under verification station 14. Verification station 14 includes a deflectable side plate 60 mounted to each side wall 42 of the frame. As shown in FIG. 4 the side plates 60 are spaced from frame side walls 42 by spacer blocks 62. Each side plate includes a member 64 having a generally triangularly shaped cross-sectional area with a sloping side wall 66 and a horizontal support wall 68. The upper corners 70 of the pair of side members 64 are spaced from each other by a distance less than the width of carton or object 18. The lower corners 72, however, are spaced from each other by a distance larger than the width of carton 18. Accordingly, when lift 31 raises its pallet 32 to deliver the cartons 18 into the verification station, the cartons cause the deflectable side plates 60 to deflect away from each other, as shown in FIG. 5, by the ends of the carton 18 contacting the sloping side walls 66 of members 64 which acts as a cam with a bending action then taking place at the upper corner of spacer blocks 62 so that the cartons are permitted to pass through the space between members 64 as shown in FIG. 6. When pallet 32 has been raised a sufficient distance to permit the members to pass beyond the upper corners 70 of members 64, the lift may be lowered if desired since the objects or cartons 18 will then be supported by the support surfaces 68 of members 64 as shown in FIGS. 6–7.

After the verification process has taken place and if it is determined that all of the intended objects are in fact present, it is necessary to load the objects into the shipping/storage container 20. This is done by again raising lift 31 so that the pallet 32 is disposed beneath the cartons 18 and the continued raising of pallet 32 elevates the row of cartons to any desired distance corresponding to the level that the cartons are to be loaded in container 20.

Advantageously the invention may be practiced by simultaneously loading a plurality of rows of cartons 18 into box 20. FIG. 4, for example, illustrates the condition before any cartons are in verification station 14. A single row is on pallet 32.

In FIG. 5 lift 31 raises pallet 32 as the first row of cartons is about to be located in verification station 14. A second row of cartons 18 is on conveyor 22 of delivery station 12.

FIG. 6 shows the second row of cartons 18 in verification station 14. When the second row is elevated into station 14, the first row rests atop the second row as shown in phantom. Lift 31 is shown in phantom being lowered with horizontal walls 68 supporting the first two rows of cartons. A third row of cartons 18 is on conveyor 22 to be deposited on pallet 32.

FIG. 7 illustrates three rows of cartons supported by walls 68. Pallet 32 is shown in phantom being lowered so that a fourth row of cartons 18 will be deposited on pallet 32.

The invention may be practiced by simultaneously loading any number of stacked rows of cartons. In the illustrated embodiment four stacked rows are simultaneously loaded.

Figure 8:
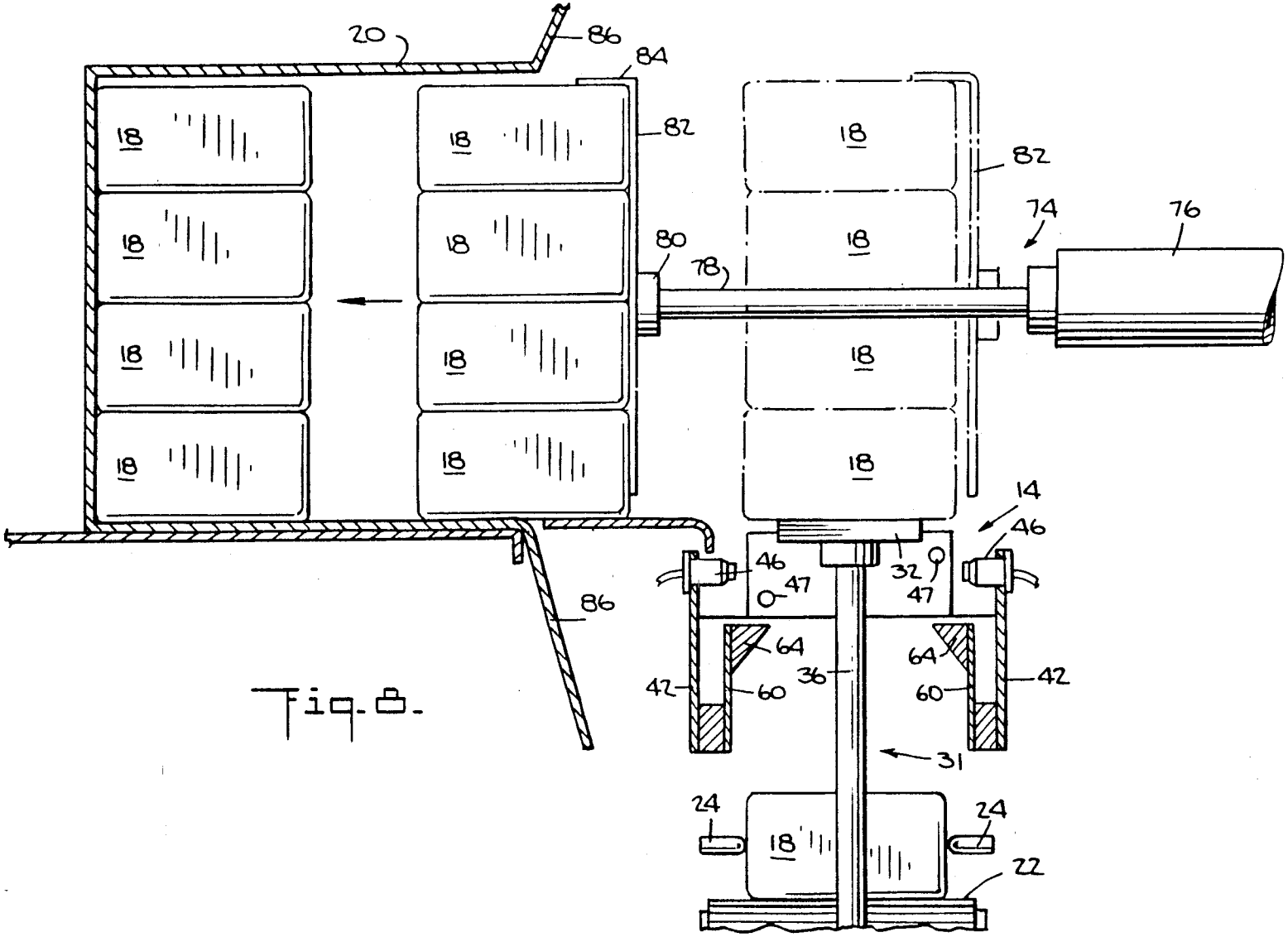
FIG. 8 is a plan view, partly in section, illustrating the loading feature for the system of FIGS. 1-7.

FIG. 8 illustrates the loading operation after the verification aspect has been completed. As shown therein, a loading ram 74 is provided opposite the open end of container 20. Loading ram 74 includes a cylinder 76 having a piston 78 which reciprocates therefrom with a head 80 provided at the end of piston 78. Ram 74 is disposed for operating in the horizontal direction whereas lift 31 operates in the vertical direction. A pusher plate 82 is secured to head 80. Pusher plate 82 includes an end flange 84.

As illustrated in FIG. 8 when a verification operation has been completed lift 31 raises four stacked rows of cartons 18 to an elevation corresponding to their intended location in container 20. Prior to the loading of the objects 18 into container 20 the verification operation would be performed on a plurality of rows of cartons by raising each completed row when the new row is being verified as previously described with respect to FIGS. 6–8. Pusher plate 82 is dimensioned so that its end flange 84 corresponds to the height of container 20. Accordingly, when the necessary number of cartons has been verified and the rows have been stacked atop each other, the top row is disposed against end flange 84. Ram 74 is actuated to simultaneously move all of the cartons into container 20 and thus completely load one vertical section of container 20. This operation is repeated until container 20 is thereby completely loaded. Flaps 86 of container 20 are then closed so that the container 20 is closed.

It should be appreciated that the verification system of this invention is particularly advantageous in that it is a non-contact signaling system which effectively detects the absence and presence of objects such as individual folding cartons. The system uses pneumatic comparators which can operate under severe environmental conditions, high pollution, noise interference, explosive atmosphere, magnetic atmosphere, total darkness, or transparency. The system is capable of detecting the presence of objects of various dimensions and shapes. All that need be done is to properly position the comparators at the verification system in accordance with the intended location of the specific objects.

While the invention has been particularly described with respect to the loading of individual folding cartons into a larger container, it is to be understood that the invention may thus be practiced for detecting the presence of other types of objects and other delivery and loading systems may be used with the verification system.

The concepts of this invention may broadly be practiced, for example, to assure that the correct number of objects is in a container. In this regard the invention might be practiced to assure that the proper number of pills is in a bottle. In such practice of the invention, the air from comparator 46 would be directed against the bottle which would cause a shifting of the bottle. When the proper number of pills is in the bottle a predetermined amount of air would be reflected by the bottle into entry port 52. If a lesser number of pills is in the bottle, the air from exit port 50 would cause the bottle to be deflected a greater distance and less air would be reflected into entry port 52 which would be sensed as previously described. Conversely, if too many pills are in the bottle, the air from exit port 50 would cause the bottle to be deflected a lesser distance than the standard deflection distance which would also be sensed as previously described.

What is claimed is:

1. A verification system for detecting the presence or absence of an object comprising a verification station, delivery means for delivering a pre-selected number of objects to said verification station with each object disposed at a selected position in said verification station, a pneumatic comparator located at each selected position, said pneumatic comparator comprising a head directed toward its corresponding selected position, said head having an exit port and an entry port, means for supplying a fluid to said head whereby said fluid may be discharged from said exit port and be reflected by the object at said selected position back into said entry port, and sensor means associated with said entry port to provide a pressure signal which indicates the presence or absence of the object at said selected position.

2. The system of claim 1 wherein said fluid is air, and a separate pneumatic comparator being provided for each selected position.

3. The system of claim 2 including an air pressure amplifier in communication with said entry port for converting the reflected low air pressure to a higher pressure signal.

4. The system of claim 3 wherein said verification station includes a frame, and said pneumatic comparators being mounted to said frame.

5. The system of claim 4 wherein said frame includes a pair of parallel sides located along said selected positions, said comparators being mounted to said sides, and pairs of said comparators being mounted in line with each other.

6. The system of claim 5 wherein said frame includes a pair of end walls, and optical sensors being mounted to said end walls.

7. The system of claim 6 including a deflectable side plate mounted to and spaced from said side walls of said frame at a location below said selected positions, said side plates including triangularly shaped members at their upper ends, each of said triangularly shaped members having an inwardly sloping surface and a top horizontal support surface.

8. The system of claim 7 including a lift for supporting the objects and raising them into said frame.

9. The system of claim 8 wherein said delivery means includes a conveyor, guide rails associated with said conveyor to maintain the objects in alignment with each other.

10. The system of claim 9 wherein said lift includes a pallet which is movable into horizontal alignment with said conveyor, and said pallet being movable past said deflectable plates to raise the objects into said frame at said selected positions.

11. The system of claim 10 including a ram for inserting the objects into a container after the objects have been subjected to a verification in said verification station.

12. The system of claim 11 wherein said ram includes a pusher plate mounted to a piston reciprocating from a cylinder, said ram being located for movement in a horizontal direction and said lift being mounted for movement in a vertical direction.

13. The system of claim 12 including an end flange on said pusher plate remote from said pallet whereby a plurality of rows of objects may be mounted atop each other and with the upper most row being moved into contact with said end flange.

14. A verification method for detecting the presence or absence of an object comprising delivering a pre-selected number of objects to a verification station with each object to be located at a pre-selected position, directing a fluid discharged from the exit port of a pneumatic comparator toward each preselected location, and measuring the fluid pressure in an entry port of the comparator to detect the presence of the object at the pre-selected location when fluid is reflected by the object into the entry port.

15. The method of claim 14 including simultaneously detecting the presence or absence of the objects by a separate comparator provided for each location of a plurality of separate positions.

16. The method of claim 15 including delivering a row of the objects to the verification station by lifting the row past deflecting members which are deflected away from each other by the objects passing between the deflecting members, and the deflecting members then supporting the objects after the row of objects has passed through the space between the deflecting members, and performing the detecting step on the entire row of objects.

17. The method of claim 16 including stacking rows of the objects atop each other, and simultaneously loading a plurality of rows of stacked objects into a container.

18. The method of claim 17 wherein the objects are folded cartons containing pharmaceutical material.

19. The method of claim 14 wherein the objects are bottle of pills.

* * * * *